US005485641A

United States Patent [19]

Machmeier et al.

[11] Patent Number: 5,485,641

[45] Date of Patent: Jan. 23, 1996

[54] COMPOSITE/PLIER CUTTER TOOL WITH SHEAR ACTION CUTTER INSERT

[75] Inventors: Paul M. Machmeier, Racine; Gregory A. Zurbuchen; Paul B. Lemens, both of Kenosha, all of Wis.

[73] Assignee: Snap-on Incorporated, Kenosha, Wis.

[21] Appl. No.: 352,431

[22] Filed: Dec. 9, 1994

Related U.S. Application Data

[63] Continuation of Ser. No. 137,367, Oct. 18, 1993, abandoned.

[51] Int. Cl.[6] ..... B25B 7/22

[52] U.S. Cl. ..... 7/134; 81/421; 81/186; 30/229

[58] Field of Search ..... 7/133–136; 81/418, 81/421, 186; 30/229

[56] References Cited

U.S. PATENT DOCUMENTS

| | | | |
|---|---|---|---|
| 80,031 | 7/1868 | Thompson . | |
| 158,205 | 12/1874 | Farmer . | |
| 458,860 | 12/1891 | Root . | |
| 921,080 | 5/1909 | Burtscher . | |
| 1,508,687 | 9/1924 | Gilley | 7/133 |
| 2,529,949 | 11/1950 | Jones et al. . | |
| 2,597,394 | 5/1952 | Snowden | 81/421 X |
| 3,090,614 | 5/1963 | Freeman et al. | 81/421 X |
| 3,514,828 | 6/1970 | Wale . | |
| 3,776,071 | 12/1973 | Krampe . | |
| 3,803,963 | 4/1974 | Hunt . | |
| 4,023,450 | 5/1977 | Ygfors . | |
| 4,407,968 | 10/1983 | Lee et al. . | |
| 4,522,633 | 6/1985 | Dyer . | |
| 4,531,555 | 7/1985 | Tatematsu et al. . | |
| 4,709,480 | 12/1987 | Takigawa et al. . | |
| 4,715,122 | 12/1987 | Linden . | |
| 4,729,170 | 3/1988 | Hartmeister | 30/229 X |
| 4,749,629 | 6/1988 | Sarin et al. . | |
| 4,820,666 | 4/1989 | Hirano et al. . | |
| 5,062,328 | 11/1991 | Demurger . | |

FOREIGN PATENT DOCUMENTS

| | | |
|---|---|---|
| 2440249 | 5/1980 | France . |
| 945804 | 1/1964 | United Kingdom . |
| 2173439 | 10/1986 | United Kingdom . |
| 2239831 | 7/1991 | United Kingdom . |

OTHER PUBLICATIONS

Coors/Ceramics specification sheet for Transformation Toughened Zirconia Ceramic.

*Primary Examiner*—James G. Smith
*Attorney, Agent, or Firm*—Emrich & Dithmar

[57] ABSTRACT

A composite, non-electrically conductive, non-sparking, non-magnetic and lightweight cutter/plier hand tool has two pivotally interconnected lever members, each of unitary, one-piece construction and formed by compression molding of multiple plies of a discontinuous random glass fiber-reinforced plastic sheet molding compound. Fixed to the jaw of each lever member is a ceramic insert made of transformation toughened zirconia, formed by dry compression and then sintering of a powdered form of the ceramic material. Each insert has a serrated gripping portion and a cutting portion, with cutting surfaces on the opposed inserts operating in shearing relationship. Three versions of the inserts are disclosed.

6 Claims, 2 Drawing Sheets

COMPOSITE/PLIER CUTTER TOOL WITH SHEAR ACTION CUTTER INSERT

This is a continuation of application Ser. No. 08/137,367, filed Oct. 18, 1993 now abandoned.

BACKGROUND OF THE INVENTION

1. Field of the Invention

The present invention relates to pivotal hand tools, such as pliers, cutters and the like and, in particular, to tools such as lineman's tools which are designed for use in applications where they may be exposed to high electrical voltage or current.

2. Description of the Prior Art

It is important in certain electrical applications that hand tools, such as pliers, cutters and the like, be electrically non-conductive to protect the user from electrical shock and to prevent short circuitry of electrical circuits. It is well known to provide electrically insulating sheaths or coatings on the handles of such tools, but such coatings provide limited electrical protection, being unsuitable for use in very high-voltage or high-current environments, such as may be encountered by an electrical utility lineman. Furthermore, such sheathing or coating can be degraded by cutting, scratching and the like, which seriously impairs its electrical insulating efficiency.

It is known to provide hand tools with handle portions formed entirely of electrically non-conductive or insulating materials, such as plastics and the like. Such tools have worked effectively in protecting the user from shock resulting from electrical conductivity through the handle. However, it has been typically necessary that the working portions, such as the jaws of pliers, cutters and the like, be formed of metal in order to provide the requisite strength, hardness and toughness for the particular tool application. Such metal working parts are subject to sparking and/or to magnetization, which renders them unsuitable for certain applications.

Another difficulty with cutter tools is that the cutting edges tend to wear and dull with use, necessitating reconditioning. It s known to provide hand tools such as pliers, cutters and the like, with replaceable metal jaw inserts, but this does not avoid the sparking and magnetization problem.

Various types of cutting tools have been provided heretofore with blades formed of material, such as ceramic, which has excellent wear-resistance characteristics. However, most ceramic materials are less tenacious than metals and have a tendency to chip or crack and, because of their hardness, once chipped, they are difficult to recondition. Furthermore, previous attempts at ceramic cutter design have proved to be difficult and expensive, since cutting edge and platen designs cannot be molded directly and require expensive machining.

SUMMARY OF THE INVENTION

It is a general object of the invention to provide an improved hand tool which avoids the disadvantages of prior hand tools while affording additional structural and operating advantages.

An important feature of the invention is the provision of a hand tool which is substantially non-conductive, non-sparking, non-magnetic, non-corroding and lightweight.

In connection with the foregoing features, another feature of the invention is the provision of a hand tool of the type set forth which has gripping and/or cutting inserts on the tool jaws.

In connection with the foregoing feature, a further feature of the invention is the provision of a hand tool of the type set forth, wherein the inserts are formed of a wear-resistant ceramic material designed with shear action cutting surfaces.

A still further feature of the invention is the provision of a hand tool of the type set forth wherein the tool body is formed of a composite, glass-fiber-reinforced, plastic material.

Another feature of the invention is the provision of a hand tool of the type set forth which is of relatively simple and economical construction.

A still further feature of the invention is the provision of a method of making a hand tool of the type set forth.

These and other features of the invention are attained by providing a non-electrically conductive and non-sparking pivoting hand tool comprising: first and second lever members respectively having cooperating jaws at adjacent ends thereof and each formed entirely of glass-fiber-reinforced plastic material, a pivot mechanism having no exposed metallic portions pivotally interconnecting the lever members in intersecting relationship for pivotal movement between open and closed conditions of the jaws, and first and second ceramic inserts respectively fixedly secured to the jaws in opposed relationship and respectively having first and second substantially parallel cutting surfaces disposed for movement in shearing relationship with each other when the jaws are moved from the open to the closed condition thereof.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
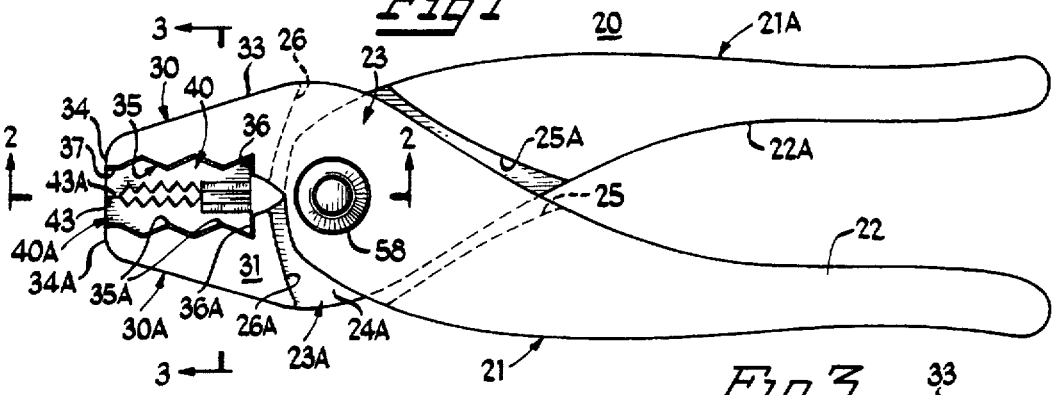
FIG. 1 is a top plan view of a plier/cutter tool in accordance with the present invention.

Referring to FIG. 1, there is illustrated a pivotal hand tool in the nature of a plier/cutter tool 20, constructed in accordance with and embodying the features of the present invention. The tool 20 includes a pair of elongated lever members 21 and 21A which are substantially identical in construction. Accordingly like parts of the lever members 21 and 21A bear the same reference numbers with the reference numbers of the lever member 21A bearing the suffix "A" for purposes of distinguishing the two lever members. The following description will be principally with respect to the lever member 21, and t will be appreciated that, although they may not all be specifically mentioned, the lever member 21A has like parts.

Figure 2:
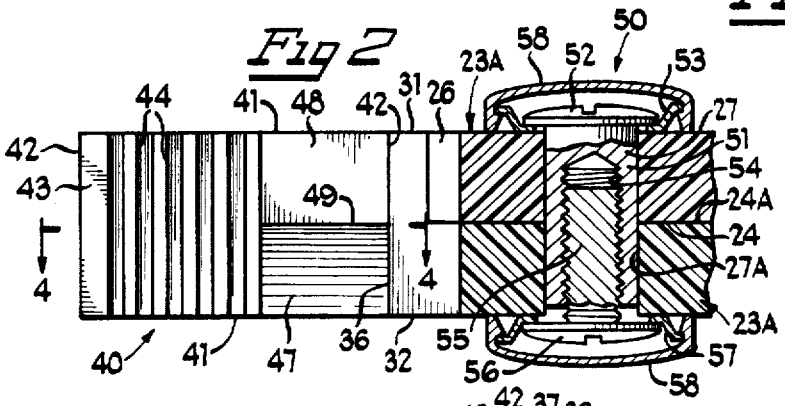
FIG. 2 is an enlarged, fragmentary view in vertical section taken along the line 2—2 in FIG. 1.

Referring also to FIG. 2, the lever member 21 includes an elongated handle portion 22 at one end thereof and a jaw 30 at the other end thereof interconnected by a reduced-thickness neck portion 23, which has a flat, planar inner surface 24 bounded at the rearward and forward ends thereof, respectively, by shoulder walls 25 and 26. Formed through the neck portion 23 is a cylindrical bore 27.

Figure 3:
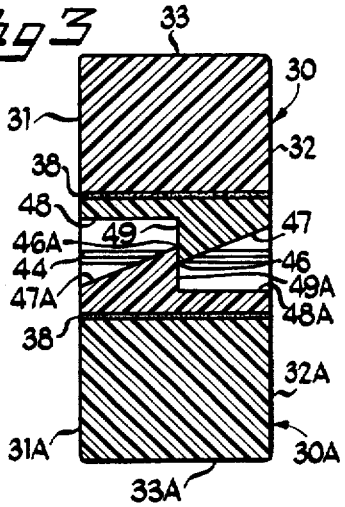
FIG. 3 is a still further enlarged view in vertical section taken along the line 3—3 in FIG. 1.
Figure 4:
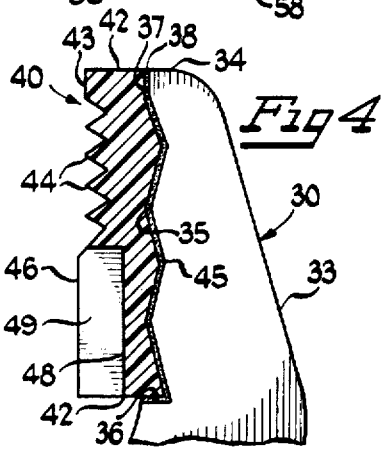
FIG. 4 is a fragmentary view in horizontal section taken along the line 4—4 in FIG. 2.

Referring also the FIGS. 3 and 4, the jaw 30 has substantially parallel side surfaces 31 and 32 interconnected by an outer surface 33, which terminates at the forward end of the jaw 30 in a nose surface portion 34. The side surfaces 31 and 32 are also interconnected by a serrated inner surface portion which is opposite the outer surface 33 and defines a plurality of sawtooth-like ribs 35, and which terminates at the rearward end thereof in an end surface 36 and at the forward end thereof in a lip surface 37 disposed substantially perpendicular to the nose surface portion 34.

The lever member 21 is of unitary, one-piece construction, being formed of a composite plastic material, preferably by a compression molding process which will be described more fully below. Specifically, the lever member 21 is molded from glass-fiber-reinforced, thermoset, polymer matrix, sheet molding compound, with the glass-fiber reinforcement being utilized in chopped or discontinuous random form. Alternatively, continuous, unidirectional glass-fiber reinforcement could be used. Preferably, the thermoset, polymer matrix, molding material is vinyl ester, which affords significant processing advantages, including fast cure rate and high workability. However, the lever member 21 could be formed of glass-fiber-reinforced epoxy materials or other plastics.

Figure 5:
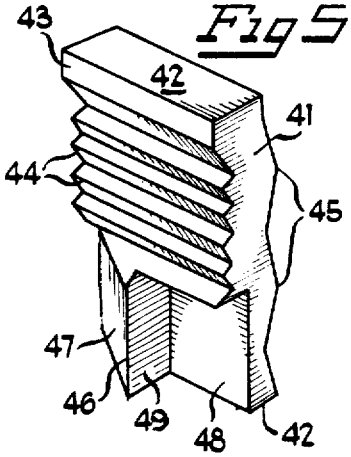
FIG. 5 is a front perspective view of the ceramic insert of the jaw of FIG. 4.

Referring also to FIG. 5, there are respectively fixedly secured to ribbed surfaces of the jaws 30 and 30A, as by a suitable adhesive 38, two inserts 40 and 40A which are substantially identical in construction. Thus, the parts of the insert 40A bear the same reference numerals as the like parts of the insert 40, but with a suffix "A", but the description will be principally in terms of the insert 40, in the same manner as is described above in connection with the lever members 21 and 21A.

The insert 40 is of unitary, one-piece construction, and is preferably formed from powdered ceramic material dry compressed in a die and then sintered, as will be explained more fully below. The insert 40 has a pair of parallel side surfaces 41 interconnected at the opposite ends thereof by front and rear end surfaces 42. The side surfaces 41 are also interconnected at the forward end of the insert 40 by a flat, planar outer surface 43 which has a plurality of transversely extending, sawtooth-shaped serrations or teeth 44 formed therein to provide a gripping surface. The opposite side of the insert 40 is provided with an inner surface with lateral serrations defining a plurality of transversely extending ribs 45. The insert 40 is provided on the outer side of its rear end with a retaining surface 47 and a recessed surface 48 joined by a shear surface 49 which extends substantially perpendicular to the recessed surface 48. The recessed surface 48 is disposed substantially parallel to the outer surface 45. The retaining surface 47 intersects the shear surface 49 at a cutting edge 46 and slopes laterally outwardly and downwardly away from the edge 46.

It will be appreciated that the width of the insert 40 is substantially identical to the width of the jaw 30, while the inner surface of the insert 40 which defines the ribs 45 is shaped and dimensioned for mating engagement with the inner surface of the jaw 30 which defines the ribs 35 in a mounted condition, with the adhesive 38 being disposed between the two mating surfaces. In this mounted condition, it will be appreciated that the side surfaces 41 of the insert 40 are respectively substantially coplanar with the side surfaces 31 and 32 of the jaw 20, with the rear end surface 42 of the insert 40 abutting the end surface 36 of the jaw 30, and with the front end surface 42 of the insert 40 being substantially continuous with the nose surface portion 34 of the jaw 30. Preferably, the adhesive 38 is a two-part epoxy adhesive which effectively permanently bonds the insert 40 to the jaw 30.

In assembly of the lever members 21 and 21A, they are arranged in intersecting relationship, with the neck portions 23 and 23A overlapping, with the inner surfaces 24 and 24A in facing relationship and with the bores 27 and 27A coaxially aligned. The lever members 21 and 21A are then pivotally interconnected by a pivot assembly 50 (FIG. 2), which includes a cylindrical pin 51 which is press-fitted in the aligned bores 27 and 27A, the pin 51 being provided at one end thereof with an enlarged head 52 which may be slotted. Preferably, when the pin 51 is inserted, it is fitted through an annular retaining ring 53 which receives the head 52, the pin 51 being inserted until the retaining ring 53 is held firmly against the outer surface of the associated one of the lever members 21 and 21A (21, as illustrated) by the head 52. The other end of the pin 51 has an internally threaded axial bore 54 therein, in which is threadedly received a screw 55 having a slotted head 56. Preferably, the shank of the screw 55 is received through an annular retaining ring 57, which is substantially identical to the ring 53, the screw 55 being threaded into the pin 51 until the retaining ring 57 is held firmly against the outer surface of the associated lever member 21A by the head 56. Thus, the pin 51 and the screw 55 cooperate to define a pivot shaft interconnecting the lever members 21 and 21A for pivotal movement between the closed condition illustrated in FIG.

1 and an open condition (not shown). The screw 55 is tightened until the parts are firmly secured together while allowing substantially free pivotal movement. Caps 58 are respectively snap-fitted over the retaining rings 53 and 57 for concealing them and the heads 52 and 56. The caps 58 are formed of an electrically non-conducting material, such as a suitable plastic or rubber, and they cooperate with the neck portions 23 and 23A to completely enclose the pivot assembly 50, so that no metallic portion thereof is exposed.

It is a significant aspect of the invention that when the parts are thus assembled, the inserts 40 and 40A are disposed in opposed facing relationship so that, when the jaws 30 and 30A are closed, the outer surfaces 43 and 43A of the inserts 40 will be disposed in an abutting, substantially coplanar relationship. It will be appreciated that the teeth 44 and 44A define cooperating gripping surfaces for gripping associated workpieces in a known manner. The shear surfaces 49 and 49A are disposed in facing, parallel, closely-spaced shearing relationship with each other, as can best be seen in FIG. 3. More particularly, it is important that the parts be carefully aligned so that the clearance distance between the shear surfaces 49 and 49A is less than 0.003 inch to ensure proper shearing action. The sloping nature of the retaining surfaces 47 and 47A serves to decrease the included angle at the cutting edges 46 and 46A, providing a narrower cutting edge, and also serves to provide clearance, which has been found to reduce the tendency for separation of the jaws 30 and 30A axially of the pivot assembly 50 during use.

Figure 6:
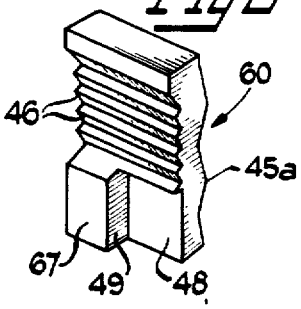
FIG. 6 is a view similar to FIG. 5, on a reduced scale, of an alternative form of the ceramic insert.

Referring to FIG. 6, there is illustrated an alternative form of insert, generally designated by the numeral 60, which could be substituted for the inserts 40 and which is substantially similar thereto with like parts bearing the same reference numbers. The fundamental difference is that the insert 60 has a retaining surface 67 which, instead of sloping, is substantially parallel with the recessed surface 48. The insert 60 operates in substantially the same manner as the insert 40, but it exhibits a greater tendency to axial spreading of the jaws 30 and 30A.

Figure 8:
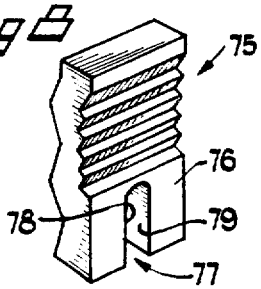
FIGS. 7 and 8 are views similar to FIG. 6 of a pair of ceramic inserts in accordance with another embodiment of the invention.
Figure 7:
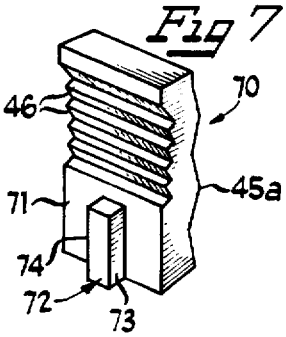

In FIGS. 7 and 8, there is illustrated another alternative form of insert. In this case, the inserts on the jaws 30 and 30A are not identical, but are rather complementary and are, respectively, designated by the numerals 70 and 75. Again, each is substantially similar to the insert 40, with like parts bearing the same reference numbers. The insert 70 has at its rear end a flat planar retaining surface 71 from which there projects, centrally thereof, a tongue 72 which is substantially rectangular in transverse cross section and defines a pair of parallel shear surfaces 73 and 74. The insert 75, on the other hand, has a flat, planar retaining surface 76 in which is formed centrally thereof an elongated groove 77, which is substantially rectangular in transverse cross section and defines a pair of parallel shear surfaces 78 and 79. In operation, the tongue 72 is adapted to fit in the groove 77 with the shear surfaces 73 and 74 respectively cooperating with the shear surfaces 78 and 79 to provide a double shearing action. This arrangement effectively eliminates the tendency for axial jaw spreading, but requires a greater cutting force than do the inserts 40 and 60.

It is a significant aspect of the invention that, except for the pivot assembly 50, the plier/cutter tool 20 has no metallic parts, being formed substantially entirely of electrically insulating, non-sparking, non-corroding materials, which are lightweight and non-magnetic. Furthermore, the ceramic inserts 40, 60 and 70 afford excellent cutting performance, their shear edges having high wear resistance and superior hardness and strength, while maintaining the non-conductive, non-sparking, non-corroding and non-magnetic characteristics of the tool 20.

Figure 9:
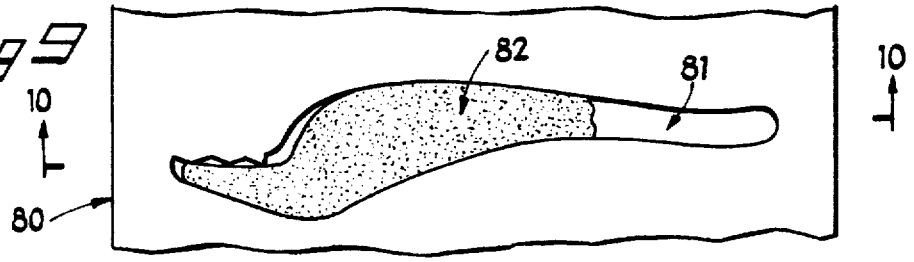
FIG. 9 is a top plan view of a female mold member for use in forming the lever members of the tool of FIG. 1.
Figure 10:
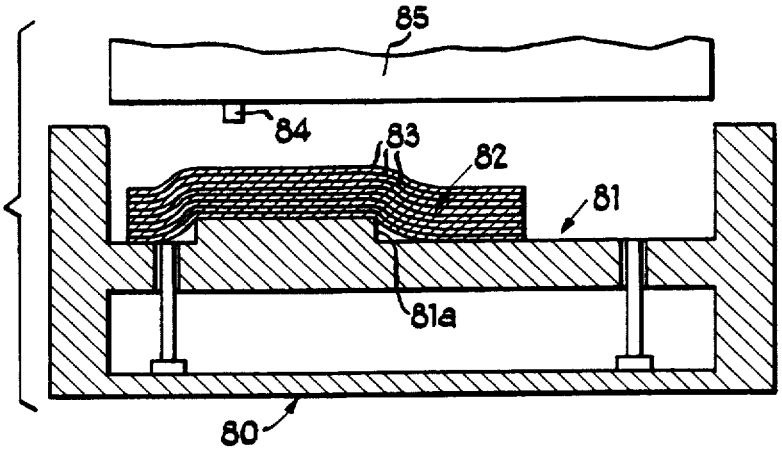
FIG. 10 is a view in vertical section taken along the line 10—10 in FIG. 9 and illustrating the male mold member with the mold open.
Figure 11:
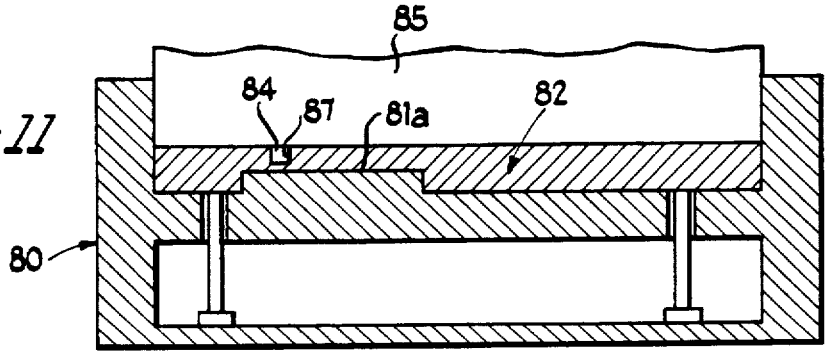
FIG. 11 is a view similar to FIG. 10, showing the mold closed.

It is another significant aspect of the invention that it is of relatively simple and economical construction. More specifically, the lever members 21 and 21A may be formed by molding techniques, and the inserts 40, 60 and 70 may be formed by conventional ceramic manufacturing methods. Referring to FIGS. 9–11, the method of forming the lever member 21 will be described. The lever member 21 is formed by a compression molding process utilizing cooperating female and male mold members 80 and 85, respectively. The female mold member 80 has a mold cavity 81 defined therein with a raised portion 81*a* to form the reduced thickness neck portion 23. A mold charge 82 is disposed in the cavity 81 and comprises a stack of a plurality of plies 83 of sheet molding compound, which is commercially available and may be of the type disclosed in copending U.S. application Ser. No. 913,221, filed Jul. 14, 1992 and entitled "Composite Hand Tool," the disclosure of which is incorporated herein by reference. As can be seen in FIGS. 9 and 10, the mold charge 82 has an area which is less than that of the cavity 81, but which has a thickness greater than that of the finished product so that, during the molding operation, the charge 82 may be permitted to flow to fill the entire cavity 81 to the desired finished product thickness. As is explained in the aforementioned copending application, Ser. No. 913,221, the specific molding temperature, pressure and cycle and cure times may vary according to the part size and mold charge placement.

Figure 12:
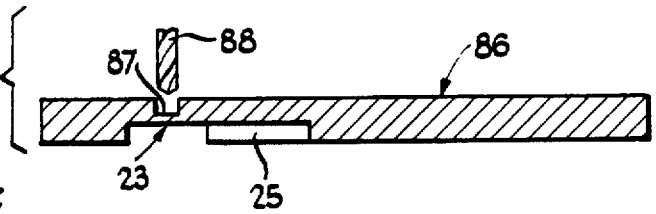
FIG. 12 is a side elevational view of the finished lever member formed by the mold of FIGS. 9 and 10, and illustrating the formation of the pivot bore therethrough.

In operation, the mold members 80 and 85 are brought together (FIG. 11) typically under hydraulic pressure, compressing the mold charge 82 in a known manner to mold a finished lever member blank 86 (see FIG. 12). Preferably, the mold member 85 has a core pin 84 projecting therefrom which forms a cylindrical recess 87 in one surface of the blank 86. After molding, the recess 87 serves as a pilot for a boring or reaming tool 88 which forms the through bore 27 in the lever member 21, as is indicated in FIG. 12. It will be appreciated that, while the lever member 21 is formed from a plurality of layers of the sheet molding compound, the finished molded product is essentially a single layer composite of unitary, one-piece construction. Because the plastic materials used to make the lever member 21 include no metallic components, the finished product is non-conductive, non-magnetic and non-sparking, and is also corrosion resistant and lightweight and has reduced tendency to mar workpieces.

While compression molding is the preferred technique for forming the lever ember 21, it could also be formed by transfer molding, wherein a slug of plastic material is placed in a heated transfer chamber and injected into the mold cavity.

Figure 13:
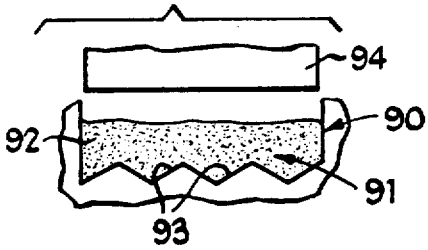
FIG. 13 is a sectional view of a die apparatus for forming the ceramic insert of FIG. 5.
Figure 14:
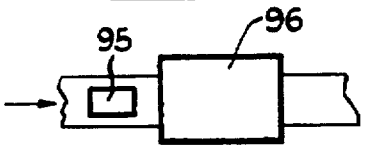
FIG. 14 is a diagrammatic view of an oven facility for sintering the insert formed by the die apparatus of FIG. 13.

Referring also to FIGS. 13 and 14, the method of forming the insert 40 will be described. The insert 40 is formed in a die member 90 which defines a cavity 91 which is filled with a powdered ceramic material with a suitable binder. Preferably, the ceramic material is a transformation toughened zirconia ("TTZ") partially stabilized with magnesia, and may be of a type commercially available from Coors Ceramics. The powdered ceramic material 92 is dry compressed in the die 90 with a ram 94 to net shape. In this regard, it will be appreciated that the die member 90 may have a sawtooth-shaped bottom surface 93 to form the ribs 45 in the finished insert, while the ram 94 has suitable formations thereon to form the teeth 44 and the surfaces 47–49 of the insert 40. As a result of this dry compression process, there is formed a "green" part 95 which is then fed through a sintering oven 96 (FIG. 14) to develop part strength. In the oven 96, the part 95 is heated at an elevated temperature below the melting point of the ceramic, but sufficiently high to allow diffusion to take place between the ceramic powder particles. It will be appreciated that the inserts 60, 70 and 75 are formed in the same manner.

It is a significant aspect of the present invention that the inserts 40 (and 60, 70 and 75) have superior toughness and resistance to cracking or chipping. This results from a phase transformation toughening. More specifically, zirconia, and certain other materials, tend to have two or more stable crystallographic phases. The magnesia partially stabilizes a crystallographic phase that is normally stable at higher temperatures. As a result, upon the occurrence of a local stress perturbation, as happens with the advance of a crack front, there is triggered a transformation to another crystallographic phase. In the case of zirconia ceramics, four-fold increases in toughness have been demonstrated by partial stabilization of a phase change from the high-temperature stable cubic phase to the low-temperature tetragonal phase. In zirconia the transformation from cubic to tetragonal phase is accompanied by a volume increase. Within the confines of a ceramic body, this expansion acts as a compressive force to close an advancing crack. The result is that it is difficult for the crack to propagate.

From the foregoing, it can be seen that there has been provided an improved pivoting hand tool which is of simple and economical construction, and which is essentially non-electrically conductive, lightweight, non-sparking, non-magnetic and corrosion resistant, while providing gripping and cutting surfaces which have superior strength, hardness, toughness and wear resistance.

We claim:

1. A non-electrically conductive and non-sparking pivoting cutter/plier hand tool comprising: first and second lever members respectively having cooperating jaws at adjacent ends thereof and each formed entirely of plastic material, a pivot mechanism having no exposed metallic portions pivotally interconnecting said lever members in intersecting relationship for pivotal movement between open and closed conditions of said jaws, first and second ceramic cutter inserts formed of transformation toughened zirconia (TTZ), and an adhesive fixedly securing said inserts respectively to said jaws in opposed relationship, said inserts respectively having first and second substantially parallel cutting surfaces disposed for movement in shearing relationship with each other when said jaws are moved from the open to the closed condition thereof, each of said inserts having a recessed surface intersecting the associated cutting surface at one end thereof and a retaining surface intersecting said cutting surface at an opposite end thereof to define a cutting edge.

2. The hand tool of claim 1, wherein each of said lever members is formed of a glass-fiber-reinforced plastic material.

3. The hand tool of claim 2, wherein said plastic material is reinforced with discontinuous random glass fibers.

4. The hand tool of claim 1, wherein said TTZ is partially stabilized with magnesia.

5. The hand tool of claim 1, wherein each of said inserts includes a serrated gripping portion.

6. The handle of claim 1, wherein said retaining surface is disposed at an acute angle with respect to the associated cutting surface.

* * * * *